US008156918B2

(12) United States Patent
Cherkasky

(10) Patent No.: US 8,156,918 B2
(45) Date of Patent: Apr. 17, 2012

(54) INTERNAL COMBUSTION ENGINE

(75) Inventor: Yakiv Cherkasky, Koblenz (DE)

(73) Assignee: DVS Innovations Technologies, LLC, Oakland, NJ (US)

( * ) Notice: Subject to any disclaimer, the term of this patent is extended or adjusted under 35 U.S.C. 154(b) by 190 days.

(21) Appl. No.: 12/319,810

(22) Filed: Jan. 13, 2009

(65) Prior Publication Data

US 2011/0048362 A1 Mar. 3, 2011

(30) Foreign Application Priority Data

Jun. 9, 2008 (DE) ..... 10 2008 028 188

(51) Int. Cl.
*F16C 7/00* (2006.01)
*F02F 3/00* (2006.01)

(52) U.S. Cl. ..... 123/197.4; 123/193.4

(58) Field of Classification Search ..... 123/197.2, 123/197.4, 193.4; 74/579 E
See application file for complete search history.

(56) References Cited

U.S. PATENT DOCUMENTS 5,655,496 A * 8/1997 Pong ..... 123/197.2
* cited by examiner

*Primary Examiner* — Noah Kamen

(57) ABSTRACT

An internal-combustion engine comprised of a cylinder with at least one piston which is moving to and fro in it, and a piston rod (6), which transforms the piston's movement to rotary motion in a crank shaft (9), and including equipment for a forcible stabilization of the piston axle. Each small end of the piston rods has an additional part (6*g*) at its right side, to produce an additional torsional moment with the aid of inertial forces. This part is characterized by its optimized form; the piston rod's big end (6*f*) includes the additional parts (6*m*), (6*n*), also at its right side; In this way, the force vectors and the torsional moment of the motor are optimized due to the effect of the inertial forces and the mass of the entire piston rod may be used to increase the inertial forces, which results in a considerable improvement of the economic and ecological properties of internal-combustion engines and other piston engines.

4 Claims, 7 Drawing Sheets

Position 0

Positions I, II - Quadrant Q

Epure of deflection moment

Positions V, VI - Quadrant R

Epure of deflection moment

INTERNAL COMBUSTION ENGINE

BACKGROUND OF THE INVENTION

The present invention relates to internal combustion engines.

In traditional internal-combustion engines, at the beginning of the working stroke, when the pressure of the gases in the cylinder is at its maximum, the torque of the crank shaft at this moment of maximum force is null, because the piston rod and the crank are in one straight line. The piston swings in the piston pin within the boundaries of the necessary temperature play of the assembly, which causes blow-by, and, hence, inevitably reduces compression. Furthermore, the pistons have an excessive length, and, hence, an excessive mass which increase inertia. The above-mentioned losses reduce efficiency.

In the internal-combustion engine disclosed in document DE 10 2007 027 202.4, the above-mentioned losses are substantially reduced. For this purpose, it includes the additional part (6*a*) at the right upper end of the piston rod. At the moment when the piston leaves the top dead centre and at the beginning of the working stroke, and its downward movement, an inertial force develops, which causes a counter-clockwise torque applied to the piston rod. Therefore, when the piston rod makes contact with the crank, a force appears, causing a clockwise torsional moment. Such torsional moments caused by inertial forces appear in all working cycles of the motor and they produce a considerable increase of the crank shaft torque, which increases the effective pressure in the cylinder. The increase improves the optimized arrangement of the force vectors during operation of the engine and it substantially improves its efficiency factor. The efficiency of the inertial forces is determined by the value of the torsional moment.

Also, the losses may be minimized by a forced stabilization of the piston axle with the aid of the guide rail and the guide beam.

An analysis of the internal-combustion engine disclosed in document DE 10 2008 027 202.4, however, reveals that it can be improved.

SUMMARY OF THE INVENTION

An object the invention is to provide an internal-combustion engine with improved economic and ecological parameters by optimizing the value and configuration of the inertial force vectors in the crank mechanism of the engine.

This object is achieved by applying an additional part in a sectional area through the piston axis, preferably in the form of a trapezium; the part abuts the small end of the piston rod, and due to its small base area, the gap between the centers of gravity of the additional part and the axis of the piston pin, and, consequently, between the values of the inertial force moment and the torque moment of the motor, respectively, is increased. The big end of the piston rod is also equipped with the additional parts. Therefore, the inertial force of the mass of the entire piston rod is used to increase the additional torsional moment due to a shift of its centre of gravity to the right of the piston axis. The axis of the special screw for attaching the beam to the guide slot of the piston guide rail is on the lower part of the cylinder with an inclination to improve the ease of installation to the periphery.

The invention is explained below based on shown examples.

BRIEF DESCRIPTION OF THE DRAWINGS

FIG. 1: The mutual arrangement of the cylinder, the beam with the guide slot, the guide rail in the slot, the piston rod, the small end, the crank and the weights at the crank shaft.

FIG. 6: The arrangement of the piston rod in the opening of the beam.

FIG. 7: The bridging of the guide beam for its attachment to the cylinder using a special screw.

DESCRIPTION OF THE PREFERRED EMBODIMENTS

Figure 1:
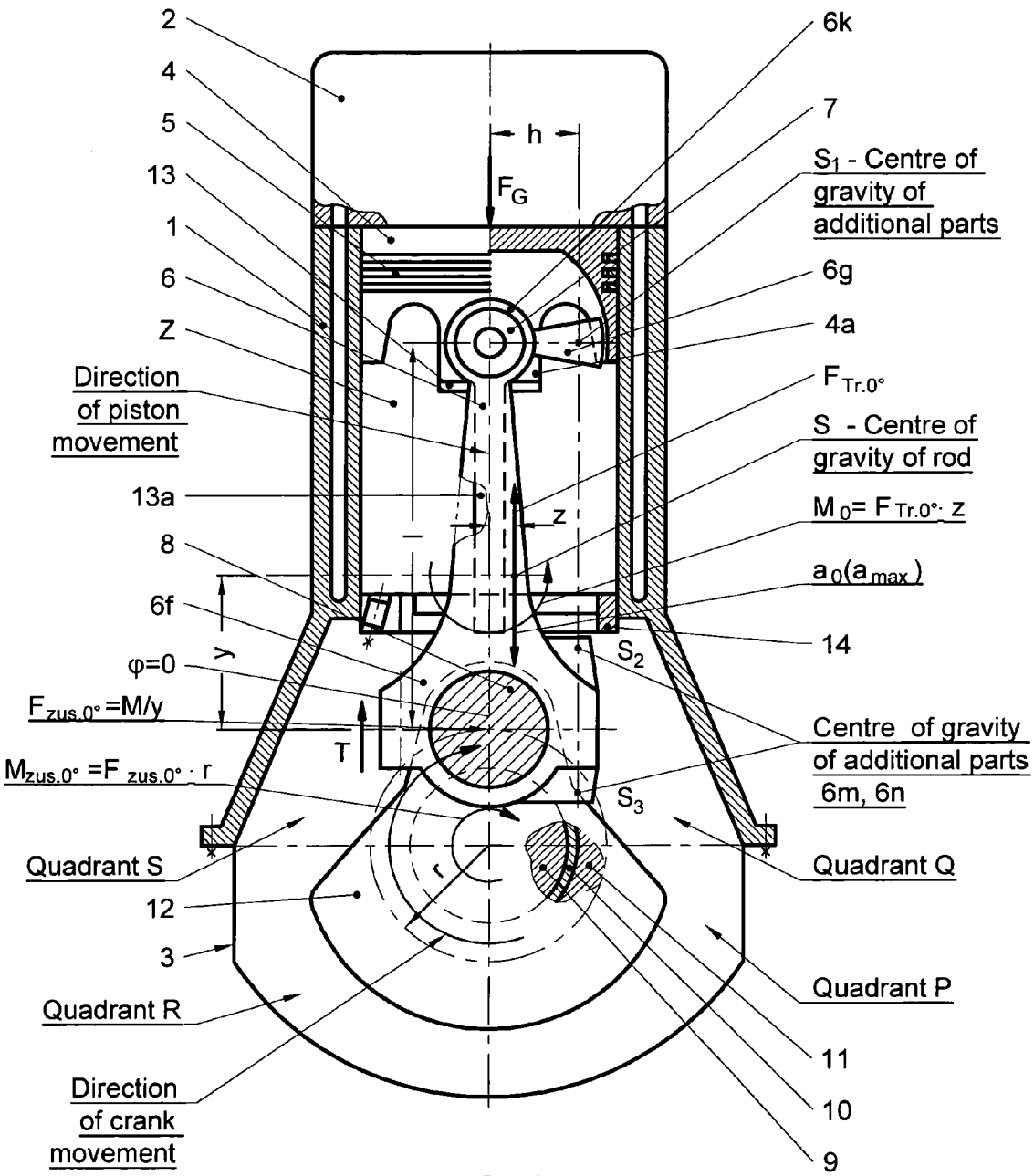
FIG. 1: A cross section of an internal-combustion engine with the additional parts to the right of the small and big ends of the piston rod and with the forced-stabilization part of the piston axis at position 0 of the piston.
Figure 3:
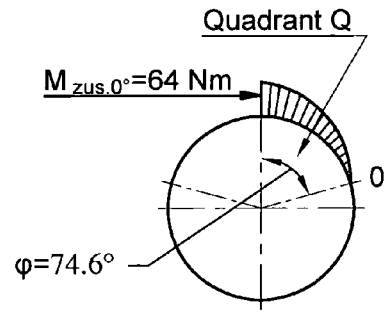
FIG. 3: An additional moment diagram of quadrant Q.
Figure 2:
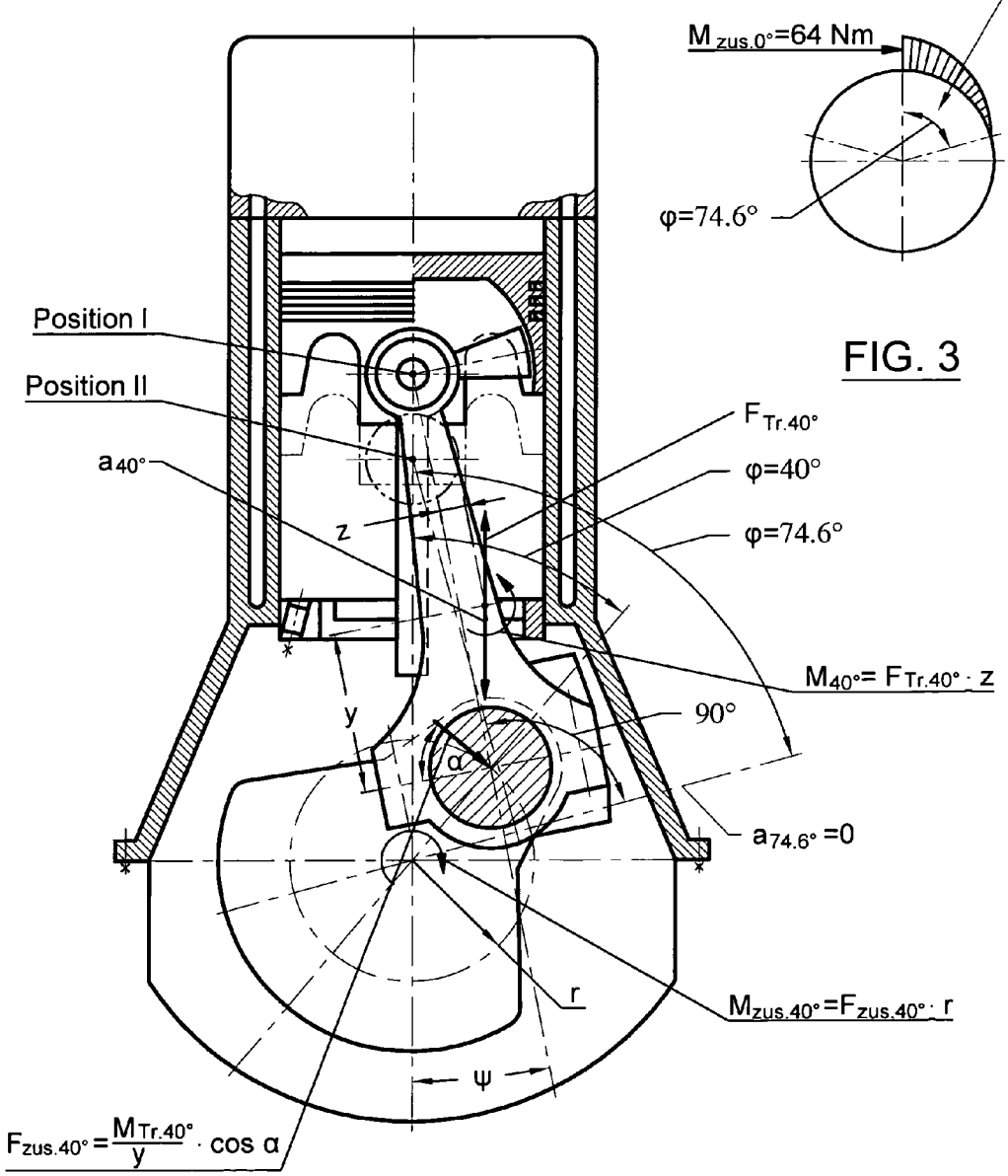
FIG. 2: The cross section at positions I, II of the piston; the crank is located in quadrant Q.
Figures 4, 5:
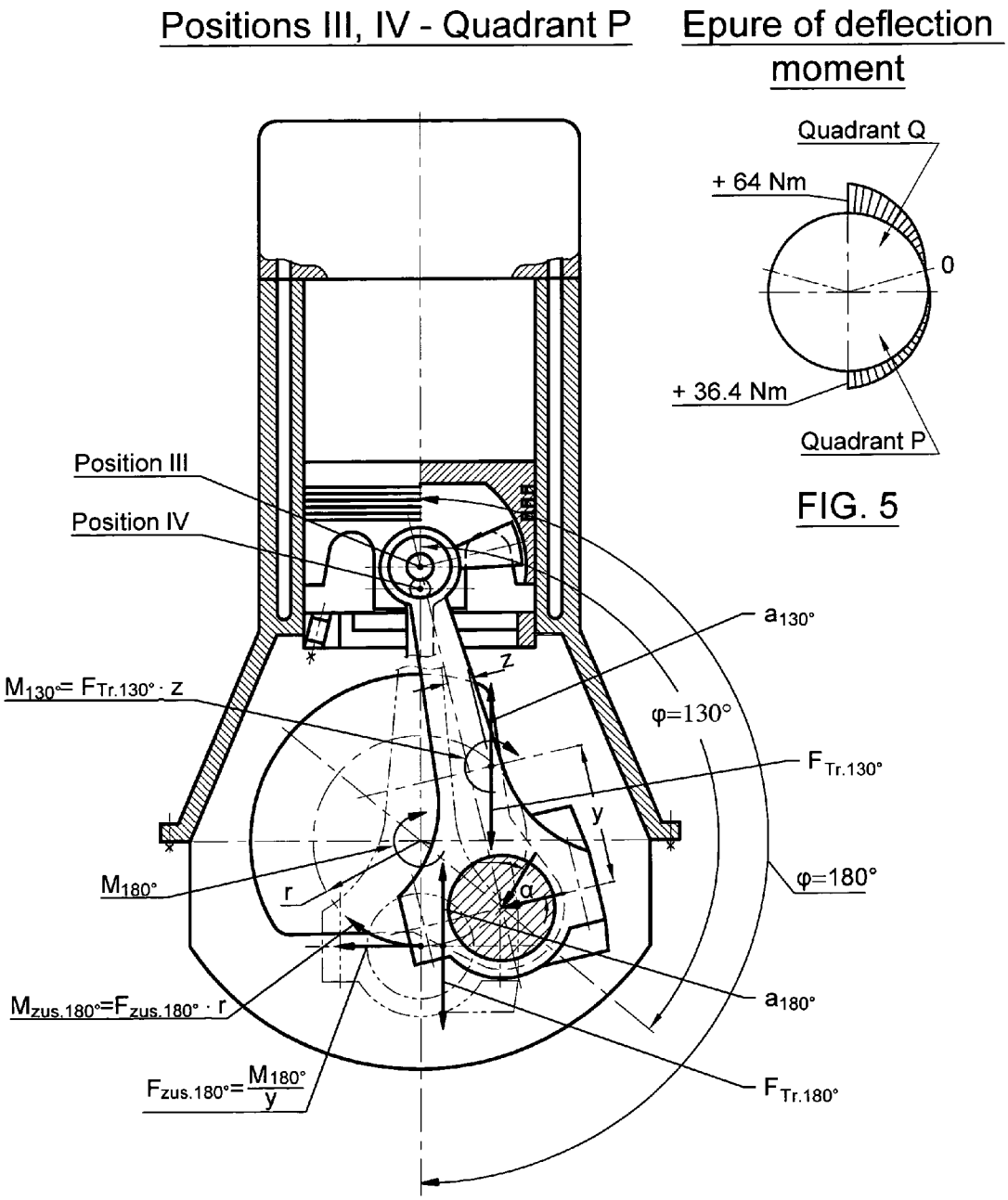
FIG. 4: The cross section at positions III, IV of the piston; the crank is located in quadrant P.
FIG. 5: Image plane of the additional moment in quadrants Q and P.
Figures 6, 7:
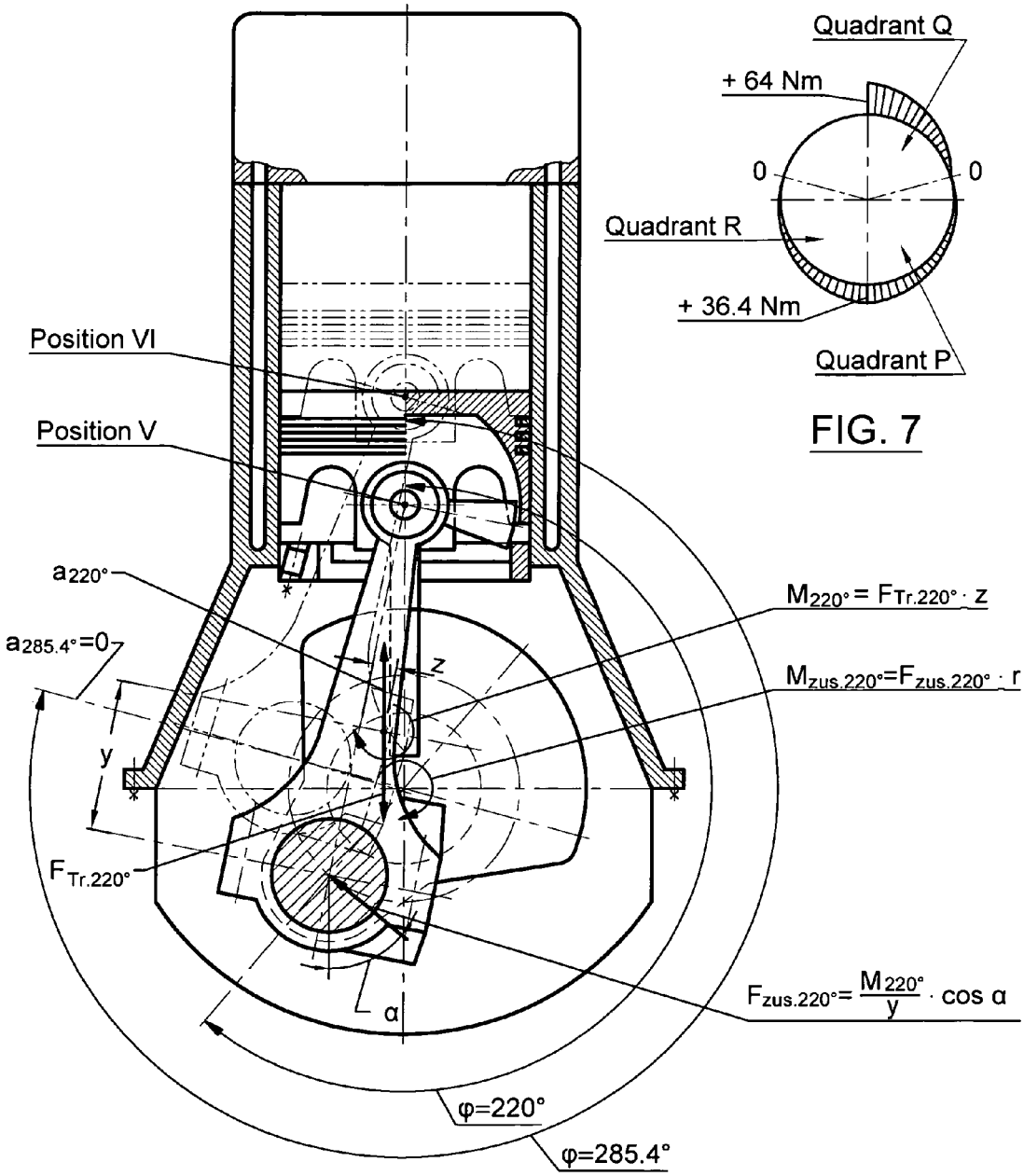
FIG. 6: The cross section at positions V, VI of the piston; the crank is located in quadrant R.
FIG. 7: Image plane of the additional moment in quadrants Q, P and R.
Figures 8, 9:
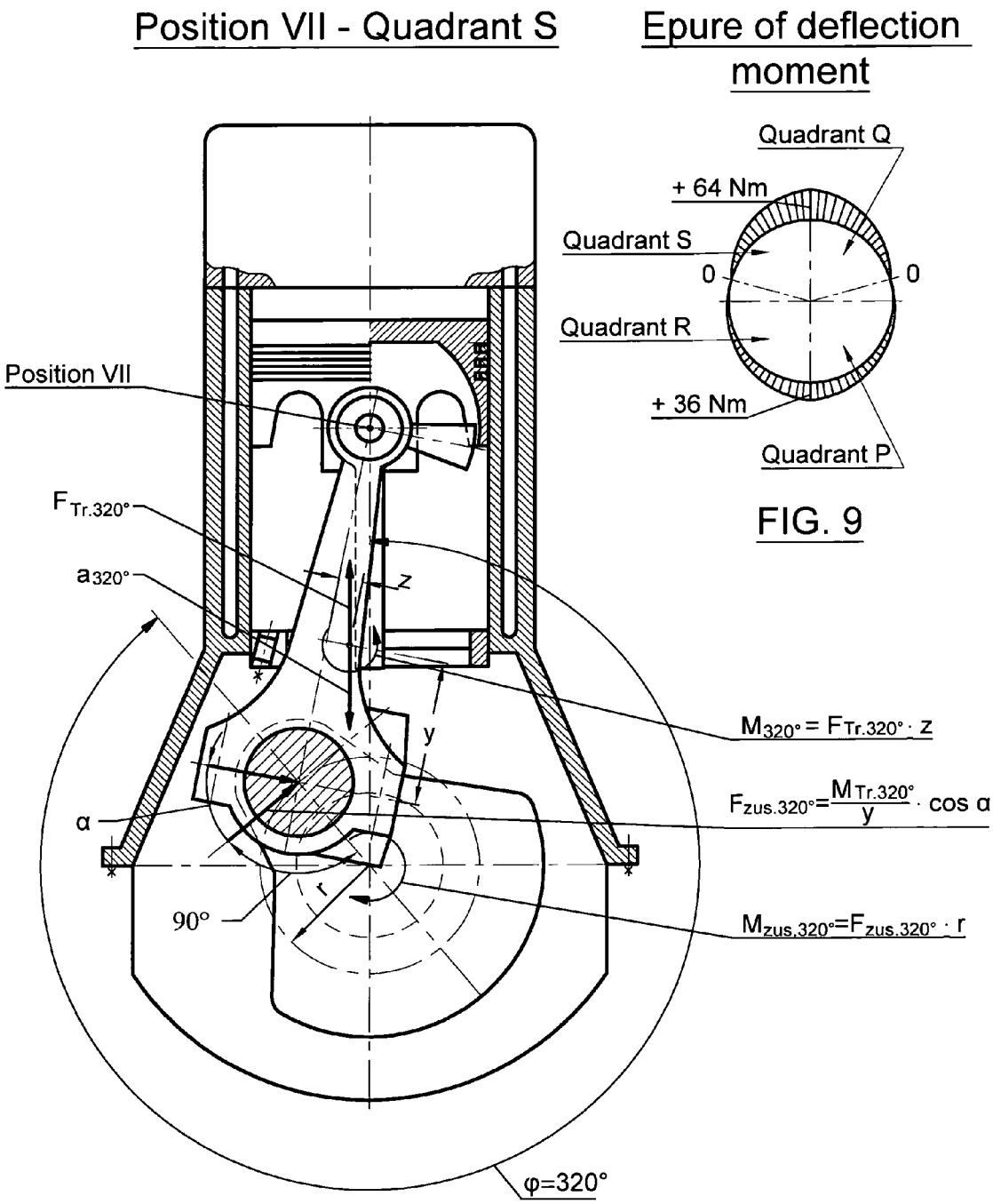
FIG. 8: The cross section in position VII of the piston; the crank is located in quadrant S.
FIG. 9: Image plane of the additional moment in quadrants Q, P, R and S.
Figure 10:
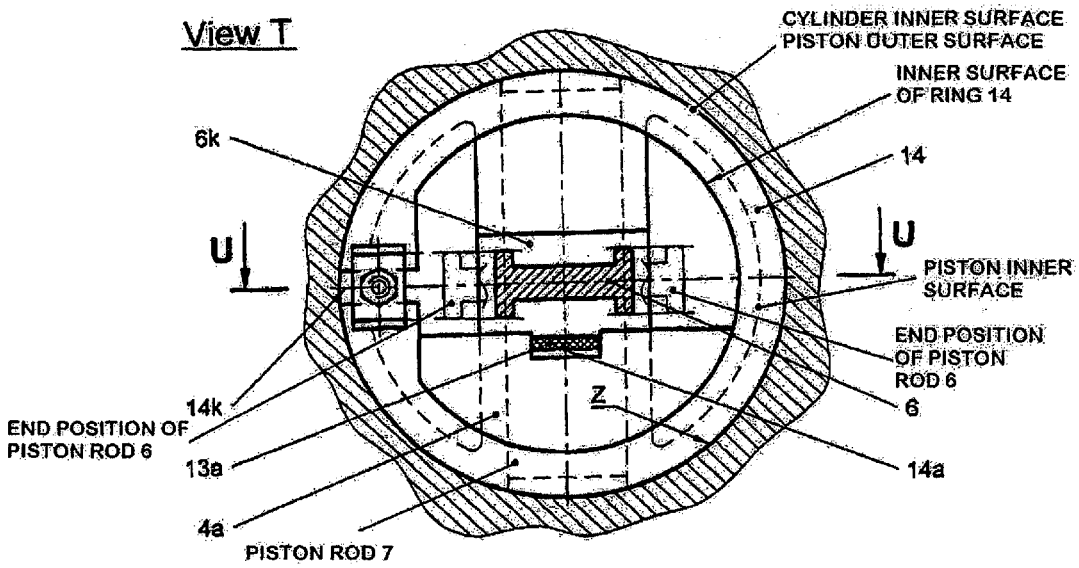
FIG. 10: A view of T as per
Figure 11:
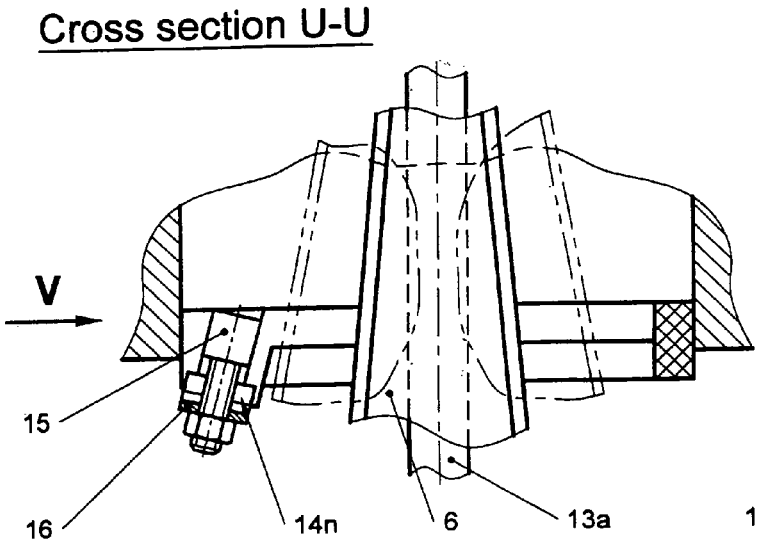
FIG. 11: Section U-U as per
Figure 12:
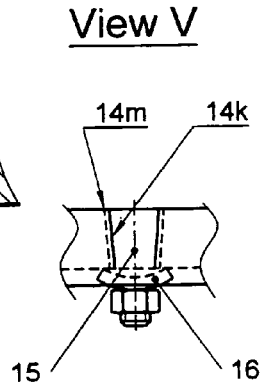
FIG. 12: A view of V as per

The internal-combustion engine consists of the cylinder block (1) with cylinders (Z), a cylinder head (2) and an oil pan (3). The cylinder (Z) contains piston (4) with compression and oil-sealing rings (5). The pistons (4) are connected with the cranks (8) of a crank shaft (9) via a piston rod (6) and a piston pin (7). The crank shaft (9) runs in bearings (10) with a covering (11). The crank shaft has counterbalancing weights (12). Each piston (4) has a guide rail (13*a*), which is mounted at a piston pin hub (4*a*). Each guide rail (13*a*) is associated with a guide slot (14*a*) of a beam (14), which is mounted in a lower part of the cylinder (Z). This forced stabilization of the piston allows for a reduction of the piston skirt. It reduces the piston mass and frees up a space for installation of the beam (14). The beam (14) has a round outer surface for its coupling with a running surface 21 and an opening for installation of the moving piston rod (6). The beam (14) has an incision for mounting inside the cylinder by securing with a special screw (15), a screw nut and a multi-point socket connector (16), which is connected with a screw nut (14*n*) to the beam (14). Additionally, the screw axis is inclined towards the periphery for easy installation of the beam (14). The incision (14*k*) is crimped (14*m*) to enable the fixation of the special screw (15). Parts (13) and (14) may be produced from plastic material.

Every piston rod (6) has at its small end (6*k*) and big end (6*f*) respective additional parts (6*g*), (6*m*) and (6*n*). The part (6*g*) in the cross-section has a trapezoid form at its junction with the small end of the piston rod to maximally distance its center of gravity from the axis of the piston pin.

The additional parts (6*m*) and (6*n*) should be placed preferably at the big end of the piston rod (6*f*) and its cap (11). The additional parts (6*g*), (6*m*), (6*n*) may either be formal integrity with the piston rod or they can be a separate assembly.

The effect of the inertial forces by the additional parts to the right of the two piston ends can be seen based on a typical internal-combustion engine, with real dimensions and parameters:

1—157 mm—the length of the piston rod;

y—60 mm—the distance between the center of gravity (S) of the piston rod and the center of gravity of the big end axle.

h=34 mm—the distance between the axis of the piston pin and the center of gravity of the additional parts (6*g*, 6*m*, 6*n*);

m6*g*=80 g—the mass of additional part (6*g*);

m6*m*+6*n*=90 g—the mass of additional parts (6*f*)+(6*h*);

mPs=600 g−0.6 kg—the own mass of the piston rod.

MPsz=600+80+90=770 g—the entire mass of the piston rod (6) without including the calculation of the new distribution of masses;

The shift of the center of gravity distance z=(80×34+90×34)/770=7.5 mm

In order to perform an analysis of its effect on the main parameters of an internal-combustion engine, it is necessary to find out the inertial forces in each quadrant—Q, P, R, S—of the crank rotation zone.

It is universally known that the inertial force FTr=−am, where a—acceleration, m—mass.

The minus sign (−) means that the direction of the inertial force vector is opposite to the direction of the acceleration vector.

Thus, in the case of this improvement of the internal-combustion engine, it would be appropriate to calculate the original combined mass of the piston and the piston rod. This can be done by the following subdivision of the masses:

The increase of mass due to the additional part (6*g*) is compensated by a shortening and, hence, a lightening of the piston because of its forced stabilization;

The increase of mass of the piston rod big end is compensated by a new distribution of masses along the piston rod.

According to the formula 13.8 from the book "Verbrennungsmotoren-Grundlagen, Verfahrenstheorie, Konstruktion" ("Internal Combustion Engines: Basics, Performance theory, Structure") by Dr. A. Urlaub—Springer-Verlag—1995, page 366, the acceleration of the piston $$Ak=dc/dt=d\phi\times d\phi/dt=r\omega^2(\cos\phi+\lambda\cos 2\phi),$$

Where r=0.0405 m—radius of crank;

λ=r/1=0.275

ω=Angular velocity of the crank shaft;

ϕ=Turning angle of the crank shaft.

The maximum rotational speed n=6100 l/min, ω=638.5 Rad/S—angular velocity.

In position 0 at the beginning of the working stroke ϕ=0.

The acceleration $a0=r\omega^2(1+\lambda)=0.0405\times638.5^2\times(I+0.275)=21051,7\ m/S^2$ Its direction points downwards.

The piston (4) moves downwards with this acceleration effected by gas pressure. The piston rod (6) moves along with a mass of appr. 0.6 kg and with the same acceleration. The inertial force of the piston rod is FTr0=0.6×21051.7=12643 N, its direction is upwards and it corresponds to the center of gravity (S) of the piston rod. This is why the inertial force produces a torsional moment Mo=FTr0z=12643×0.0075=94.8 Nm, which has a counterclockwise direction.

The contact of the piston rod's big end with the crank (8) causes the force Fzus.sub.0=M.sub.o/y=94.8/0.06=1580 N.

This force produces a torsional moment at the crank shaft (9) with a clockwise direction. This is the reason for the additional principal moment of the motor.

This additional torsional moment

Mzus.sub.o=Fzus.sub.0.sup.xr=1580.times.0.0405=+64 Nm.

This means, that at the beginning of the working stroke in any internal-combustion engine, which has been modernized according to the invention—and unlike all traditional motors—a substantial torsional moment, caused by inertial forces, appears.

For example, in quadrant Q, with .phi.=40.degree., the piston (4) is in position I: .alpha.

The acceleration a.sub.40=r.omega.sup.2(cos .phi.+.lamda. cos 2.phi.)=0.0405.times.638.5.sup.2.times.(cos 40.degree.+0.275.times.cos 80.degree.)=12647.6 m/S.sup.2.

It has a downwards direction. Therefore, the inertial force F.sub.Tr.40=12647.6.times.0.6=7588.6 N.

The torsional moment at the piston rod by this inertial force is M.sub.Tr.40=F.sub.Tr.z/cos .PSI.40, where .PSI.—is the angle of inclination of the piston rod.

M.sub.Tr40=7588.6.times.0.0075/0.98=58.1 Nm.

The additional force F.sub.zug40=M.sub.Tr40.times.cos .alpha./y=58.1.times.0.643/0.06=746.8 Nm;

(.alpha.=90.degree.−40.degree.=50.degree.).

The additional torsional moment at the crank shaft

M.sub.zus40=F.sub.zus40.times.r=746.8.times.0.0405=+30.9 Nm. This torsional moment also has a clockwise direction. This means that this torsional moment adds up with the principal torsional moment of the motor.

Moreover, one can imagine the piston rod as a lever, which rotates around the piston axle and is connected to the crank (8).

During the movement of the piston rod (6) with the above-mentioned downward acceleration, an inertial force with an upward direction appears. This inertial force corresponds to the center of gravity (S) and therefore keeps the piston rod down. Therefore, when the big end of the piston rod makes contact with the crank (8), a force develops, which additionally works to rotate the crank in a clockwise direction. This force essentially produces an additional torsional moment by the inertial force in the crank shaft of the internal-combustion engine.

In position II, the angle between the piston rod (6) and the crank (8) is 90.degree. In this position, the acceleration of the piston starts a change in its direction, i.e. the acceleration in position II is null.

In quadrant P, the value of the acceleration increases from null in position II of quadrant Q to the value in position IV of the piston, when the piston rod (6) is in a vertical position. The acceleration vector direction is upwards. This means that the direction of the inertial force vector is downwards, i.e. the inertial force also develops a torsional moment with a clockwise direction after position II. For example, with (normal text) ϕ=130°, an acceleration $a130=-11859\ m/S^2$ develops, and, accordingly, the additional torsional moment is Mzus.130=23.1 Nm, with a clockwise direction as well.

Position IV contains the bottom dead center. There, the acceleration vector has its maximum negative value $a180=r\omega^2(1-\lambda)=-11970.6\ m/S^2$. The additional torsional moment is Mzus.80=+36.4 Nm, with a clockwise direction as well.

In quadrant R, the acceleration goes upwards, with a gradually decreasing value. For example, in position V of the piston, with ϕ=220°, the acceleration $a220=11405\ m/S^2$. The inertial force is FTr.220=6843 N. Its moment is M220=51.3 Nm. The additional torsional moment at the piston shaft is Mzus.220=+34.6 Nm.

After the transition of the crank (8) in quadrant S, the acceleration value of the piston (4) and, consequently, of the piston rod (6) gradually decreases, which is reflected in the diagram of the additional torsional moments. With ϕ=287.6i° when the piston rod is perpendicular towards the crank (8), the acceleration a287.6=0. In the course of the further rotation of the crank, the acceleration changes its direction, and its value starts to increase. For example, the acceleration a320=12647 m/$S^2$ The additional torsional moment at the crank shaft, in position VII of the piston, is Mzus.320=+30.9 Nm. During further rotation of the crank shaft (9), the acceleration grows and the piston returns to its starting position—position 0—with the additional torsional moment Mzus.0=+64 Nm. The cycle repeats.

The interaction of the guide rail (13*a*) with the guide slot (14*a*) of the beam (14), which is attached to the lower part of the cylinder, reduces the swinging amplitude of the piston around the piston pin several times. This forced stabilization of the piston axle minimizes the losses of gas in the crankcase. Therefore, the compression is substantially increased, which increases the effective pressure and, consequently, the degree of efficiency. The reduction of the gas losses very much reduces the total amount of gases in the case, which increases the effective pressure, and, consequently, the efficiency of the motor. The reduction of gas losses and the simultaneous reduction of the total amount of gases result in a lowered oxidation of engine oil. This correspondingly increases the engine's service life. In addition, the reduction of gases in the crankcase is beneficial for the environment, because a certain part of these gases would otherwise inevitably be released to the outside by the catalytic converter through the ventilation system of the crankcase.

The optimization of form of the additional part (6*g*) to the right of the small end of the piston rod and the arrangement of the additional parts (6*m*), (6*n*), also located to the right of the small end, allow for an optimal utilization of the entire piston rod mass in all quadrants—Q, P, R, S—which considerably improves the efficient use of the effect inertia forces. The forced stabilization of the piston axle reduces internal losses and substantially increases the effective pressure and the efficiency of the motor. The optimized configuration and value of the applicable vectors in the motor help to transform the inertial forces from detrimental/resisting forces into useful forces.

The following advantages are obtained:

The fuel consumption and, respectively, exhaust emission is reduced. The life cycle of motor oil is increased.

The wear of the piston rings, the piston and the cylinder is reduced.

Less material is used for the production of any piston machine applying these technical solutions.

The accelerating ability is enhanced by the smaller moving masses, e.g. the smaller mass of the flywheel.

The ecological properties of the internal-combustion engine and of other piston machines are improved.

The invention increases the effective pressure in internal-combustion engines, optimizes their economic and ecological properties by realizing the reserves of their crank mechanisms with the aid of the inertial forces, caused by the additional parts to the right of the small and big ends of the piston rods; furthermore, the ease of installation the stabilizing element of the piston axle is improved due to the inclined configuration of the special row.

The invention claimed is:

1. An internal combustion engine, comprising a cylinder having a substantially vertical axis; a piston reciprocatingly movable in said cylinder; a crankshaft; a piston rod converting the reciprocating motion of said piston into a rotary motion of said crankshaft; means for stabilization of a piston axis, wherein said piston rod has a small end that is provided at its right side with an additional part having a small base area abutting against said small end of said piston rod and producing a torque on said crank shaft, and wherein said piston rod has a big end that is provided at its right side with further additional parts producing a torque on said crank shaft.

2. An internal combustion engine as defined in claim 1, wherein said additional part on said small end of said piston rod has a shape of a trapezium.

3. An internal combustion engine as defined in claim 1, wherein said piston axis stabilization means include a beam having a guide slot and provided in a lower part of a cylinder, and a straight guide rail provided on said piston and cooperating with said slot.

4. An internal combustion engine as defined in claim 3 further comprising a screw attaching said beam and being inclined to faciitate installation, wherein said screw has a wedge head fixed in inclined slots; and a socket connector is fixed by slots.

* * * * *